US006557567B2

(12) United States Patent
Mood

(10) Patent No.: US 6,557,567 B2
(45) Date of Patent: May 6, 2003

(54) DEVICE FOR WASHING A REUSABLE STORAGE BAG IN A DISHWASHER

(76) Inventor: Stattler A. Mood, 711 Cactus Bend Dr., Pflugerville, TX (US) 78660

( * ) Notice: Subject to any disclaimer, the term of this patent is extended or adjusted under 35 U.S.C. 154(b) by 101 days.

(21) Appl. No.: 09/826,034

(22) Filed: Apr. 4, 2001

(65) Prior Publication Data

US 2002/0144963 A1 Oct. 10, 2002

(51) Int. Cl.[7] ..... B08B 9/093; A47F 7/00
(52) U.S. Cl. ..... 134/22.18; 211/12; 211/41.8
(58) Field of Search ..... 134/22.1, 42, 22.18; 211/41.9, 41.8, 12, 85.15

(56) References Cited

U.S. PATENT DOCUMENTS 946,108 A * 1/1910 Carpenter ..... 211/12
5,080,237 A 1/1992 Hefner
5,096,503 A * 3/1992 Wellman ..... 134/221
5,172,837 A 12/1992 Finney, Jr. et al.
5,303,827 A * 4/1994 Ross ..... 211/85.15
5,405,018 A 4/1995 Anthrop, Jr.
5,538,050 A 7/1996 Galdon
5,794,792 A 8/1998 Convertino

* cited by examiner

*Primary Examiner*—Randy Gulakowski
*Assistant Examiner*—Saeed T Chaudhry

(57) ABSTRACT

A device for washing a reusable storage bag in a dishwasher formed by a frame assembly of one or more main bar(s) joined with one or more connecting bar(s). Intersecting crossbars act both to spread open the bag and hold it for washing, utilizing a snugness of fit between the crossbars and the bag and its sealing strips. The device has holes in the bottom of the main bar(s), which allow it to be placed and secured onto any of the vertically oriented branches of the dish trays common to conventional dishwashing machines. The device is designed to hold and spread the bag apart wide enough to allow the washing jets of a conventional dishwasher to reach even the corners of the bag, thereby cleaning it inside and out.

15 Claims, 6 Drawing Sheets

DEVICE FOR WASHING A REUSABLE STORAGE BAG IN A DISHWASHER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

The invention relates to reusable storage bags that are commonly used to store foodstuffs, and specifically to a novel device onto which such a bag is placed so that it can be washed. The device is then placed in a conventional dishwashing machine, which is then run through a washing cycle.

In today's society, reusable storage bags are ubiquitous and widely used and known as freezer bags or food storage bags. Although there are several manufacturers of such bags, there are a limited number of sizes widely sold, several of which are of similar widths. Generally used for storing foodstuffs, these bags are composed of a flexible plastic material, and have two raised ridges, or "sealing strips." The sealing strips join together to form a seal when pressure is applied from one end of the sealing strips to the other, making the bags both air and watertight. The sealing strips may be resealed repeatedly without damage to the bags. Some bags have a plastic sliding attachment that closes the sealing strips as it moves over them. These characteristics serve to make such bags very useful, durable and reusable. However, washing these bags is a daunting proposition since any manner of foodstuffs may have been present inside and the outside is easily dirtied as well. Furthermore, said bags are flexible and wrinkle easily, which makes it very difficult to hold them flat to wash by hand with a washrag or other washing utensil. The inside is even harder to wash as it requires insertion of both the washer's hand and a washrag into the bag, where range of motion of the washer's hand is limited by the bag's size. It is particularly difficult to wash the inside corners of said bags since the average human finger, especially with a washrag surrounding it, cannot physically fit into the very corners of said bags. Many people simply throw these bags away after only one use because there is not an easier method of effectively washing them. Disposing of these bags after only one use is economically wasteful and environmentally burdensome, as the bags' plastic composition makes them unlikely to degrade quickly once disposed of in a landfill. The bags themselves are also of sufficient expense that many people would reuse them if there were an easier and more effective method of cleaning them.

A device for using a dishwasher to wash an article other than dishware is shown in the Finney, Jr., et al. U.S. Pat. No. 5,172,837, but it is directed towards washing a ball cap in a dishwasher. A device for supporting plastic bags for washing and drying is shown in the Hefner U.S. Pat. No. 5,080,237, but it is not directed for use in dishwashers. The Galdon U.S. Pat. No. 5,538,050 is directed towards supporting a pastry bag for filling, drying, storing or cleaning, including cleaning in a dishwasher, but is specifically directed towards pastry bags.

The Anthrop, Jr. U.S. Pat. No. 5,405,018 and the Convertino U.S. Pat. No. 5,794,792 are known to be directed towards washing plastic bags in a dishwasher. However, the Anthrop and Convertino devices have inherent limitations and structural differences that are readily apparent when compared to the claimed device. Significantly and specifically, in the Anthrop device, the bag being washed is not opened sufficiently to allow cleaning of the interior of said bag, especially the corners thereof, which are obscured by the Anthrop device itself. Indeed, as described in the Anthrop patent, the preferred use of the Anthrop device is with the bag "turned inside out first," which requires a cumbersome first step on the part of the user, and implies that the cleaning of a bag is largely limited to the outer surface. The Anthrop device requires the user to place each end of a semi-rigid tube over two branches of a dishwasher tray at a width and height necessary to support the bag being washed. This requires the user to use two hands and bend over the dishwasher to place the Anthrop device, and again to place the bag on the Anthrop device, all while avoiding the other branches of the tray, which can easily interfere with the user's hands. The removal of a bag from the Anthrop device is likewise cumbersome and requires two hands. The Anthrop device must be adjusted for every different size of bag that is placed on the device. The Anthrop device must be attached to two vertical branches of the trays commonly found in dishwashers. The Anthrop device requires no fewer than three distinct parts.

The Convertino device utilizes "support members" and "retaining fingers" which interfere with the thorough cleaning of the interior of such bags. Some of these "support members" are positioned under the corners of the bag, which interferes with the cleaning of the corners. The "support members" and "retaining fingers" also constitute a large surface area that comes into contact with the bag being washed, again inhibiting its thorough cleaning. The Convertino device does not provide a means for attaching the device to the dishwasher tray, meaning the device is not securely held, limiting its ability to maintain the orientation of the bag opening toward the dishwashers' water jets and thus its ability to clean the bag. The Convertino device is also cumbersome and complicated to use, requiring two hands for the attachment of at least one (and likely four) "retaining finger(s)," to the bag to be washed, in which the edges of the bag opening must be pushed between the "retaining finger(s)" and the "base structure." As the bag to be washed is dirty, and possibly greasy, gripping the bag and forcing the thin edge of the bag between the "retaining finger(s)" and the "base structure," all while holding the device can be an unpleasant and difficult proposition. The Convertino device is designed to fit only a single size of bag and requires no fewer than three parts.

The claimed device has no such limitations or requirements and utilizes a novel approach to cleaning reusable storage bags in a dishwasher which is more versatile, more effective, easier to operate and requires fewer parts than the prior art. Accordingly, several objects and advantages of the claimed device are as follows:

It is an object of the invention to provide a novel device onto which a reusable storage bag may be placed and then secured to the interior of a conventional dishwasher for the purpose of thoroughly washing both the interior and exterior surfaces of the bag, including the corners. It is an advantage of the device that the bag being washed is held open with minimal surface area contact between the device and the bag, so that both inner and outer surfaces, including corners, are washed thoroughly and simultaneously. It is an advantage of the device that it can be secured to a dishwashing machine tray.

It is an object of the invention to provide a novel device that is easy to use. It is an advantage of the device that a bag can be easily placed and secured onto the device while the device is outside of the dishwashing machine. It is an advantage of the device that it can be held by the user in one hand and inserted into a bag held in the user's other hand. It is a further advantage that no retaining fingers or clips must be held or forced open while securing the bag to the device, nor when removing the bag from the device. It is an advantage of the device that it can be secured to and removed from a single branch of a dishwasher tray, and to do so by using only one hand. It is an advantage of the device that it can be used to wash more than one size of bag without any adjustment to the shape or size of the device. It is an advantage of the device that it can be configured to be easily adjustable to accommodate an even wider range of bag sizes.

It is an object of the invention to provide a novel device that is both simple to construct and economical to manufacture. It is an advantage of the device that it can be constructed as a single integral part and of inexpensive materials.

It is an object of the invention to provide a novel device that is made of a material that will not readily rust, corrode or otherwise easily degrade within the dishwasher environment. It is an advantage of the device that it can be constructed of any of several durable materials.

It is an object of the invention to provide a novel device that encourages the washing of reusable storage bags rather than throwing them away. Further objects and advantages of my invention will be apparent from a consideration of the following description.

BRIEF SUMMARY OF THE INVENTION

The novel device in its preferred form consists of a frame, on which crossbars protrude outwards perpendicularly along each bar of the frame. The crossbars act to both spread the bag open, allowing all interior surfaces to be cleaned, and create a snugness of fit, keeping the bag in place in the face of the water jets common in conventional dishwashers. Key to this fit is that the lowest crossbars are positioned so that when a bag is placed on the frame, the sealing strips of the bag overlap and abut to these crossbars, acting to hold the bag in place. An important element is that the other crossbars can be used to hold shorter bags in a similar manner. Another important element is that the upper crossbars are positioned such that they will permit water flow into the interior corners of the bag. Another important element is that the contact area between the interior of the bag and the claimed device is limited to the very ends of the crossbars themselves, which minimizes the contact area between the bag and the device. Another important element is that there is no contact between the device and the outside of the bag, such as clips or fingers. These elements act to maximize the ability of the dishwasher to thoroughly clean the entire bag. In the best mode of construction, the device is an integral part formed of molded plastic, though other materials and methods of construction are contemplated. An alternative embodiment would include a hold-down strap, which would fit on the outside of the bag and act as additional security for holding the bag on the device, in case of extremely strong dishwashing jets. Another alternative embodiment would utilize an extendable, telescoping frame, which would allow the width and height of the device to be adjusted to accommodate a wider variety of sizes of bags. Another alternative embodiment would allow two or more of the devices to be joined together to wash larger sizes of bags.

DETAILED DESCRIPTION OF THE INVENTION

Figure 1:
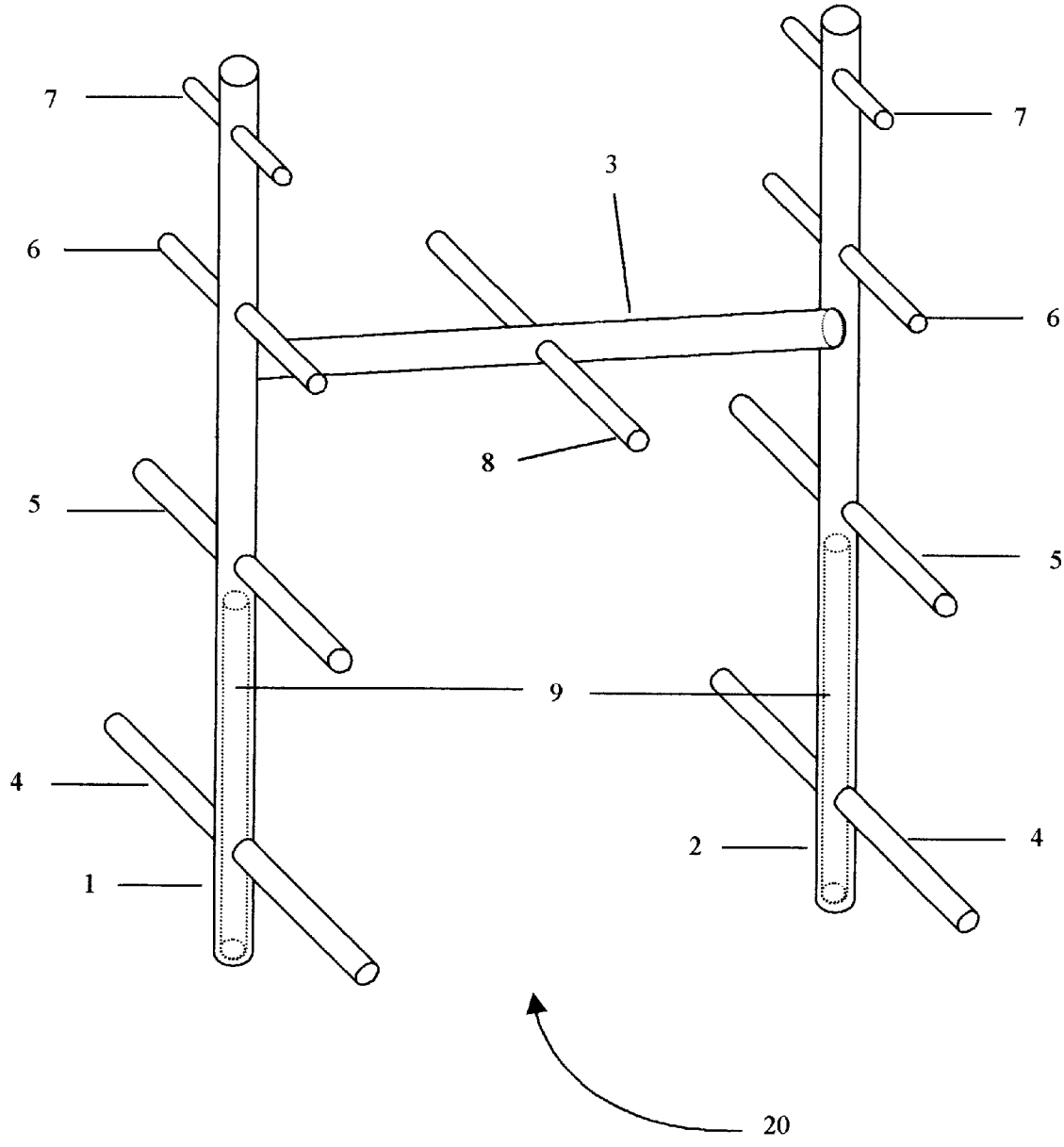
FIG. 1 on page 1 of the drawings shows the preferred embodiment of the novel device.
Figure 2:
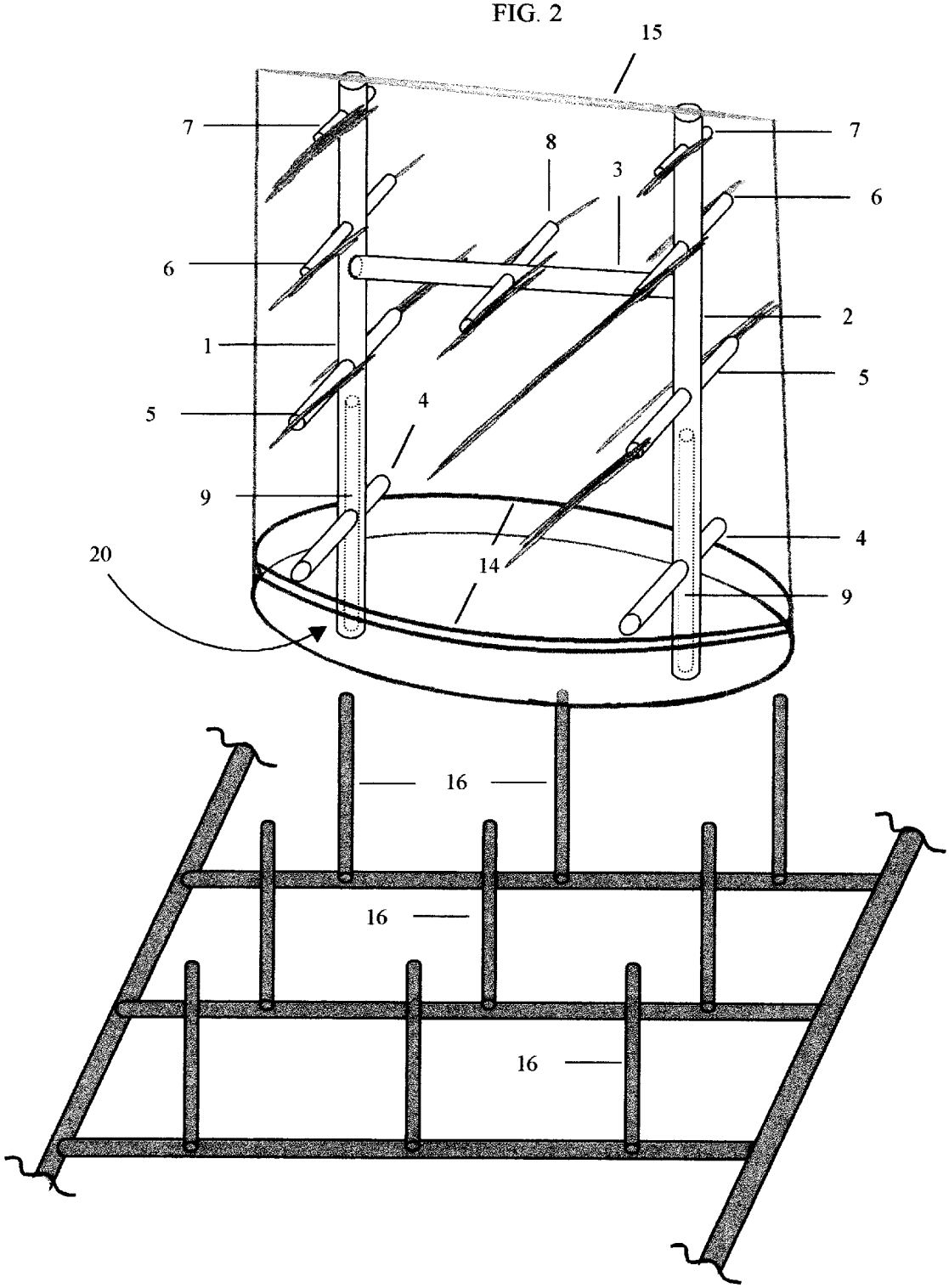
FIG. 2 on page 2 of the drawings shows a bag placed onto the preferred embodiment of the novel device, as it is being lowered onto one of the vertical branches of a dishwashing machine tray.

The novel device will now be described by referring to FIGS. 1–8 of the drawings. The preferred embodiment (20) is shown in FIGS. 1–2. As shown in FIG. 1, the device is composed of two main bars (1&2) which are joined together by a connecting bar (3), which is a specified distance from one end of the frame. On the main bars (1&2) are several spaced pairs of crossbars (4–7). Each pair of crossbars is placed at a predetermined distance from one end of the frame, one member of each pair on each main bar, each member of a pair being the same length. The connecting bar (3) also has a crossbar (8) that is a specified length. The crossbars act to both hold the bag and spread it apart so that the water jets of the dishwasher may reach the entire interior surface, including the corners. The crossbars stretch the bag only enough to secure it, not so much that is becomes taut around the frame. In this way, the space between the main bars and the bag is maintained by the bag's inherent shape, and the bag is free to wiggle slightly, so that even the minimal contact points between the bag and the crossbars are cleaned. As shown in FIG. 2, the key to this secure, yet not too tight fit, is that the sealing strips of the bag abut to and are held by the lowest crossbars (4). The main bars (1&2) of the frame each have holes (9) in the bottom that are of a diameter and depth slightly greater than the diameter and length of the vertically-oriented branches (16) which are commonly found in a typical dishwashing machine tray. Although only one hole is needed to secure the device to a dishwasher tray branch, holes are formed in each main bar for ease of use, so the user does not have to remember which main bar has the hole. In operation, the device (20) is inserted into the bag, and then placed in the dishwasher's tray so that one vertical branch (16) is inserted into one of the holes (9) found in the main bars. The device is thus held securely, properly orienting the bag with its opening towards the dishwashing machine's water jets.

The lengths and spacing of the main bars, connecting bar and crossbars serve to support the bag, keep it open for cleaning, and hold it onto the device, and could all be varied based on the size of bags for which the device is designed. Though there could be as many different sizes of the device as there are sizes of bags, any one size of the device can be configured to fit two or more sizes of bags. Key to this configuration is the length and positioning of the crossbars. As shown in FIG. 2, the device is designed for a bag of a given maximum size, so that the lowermost crossbars (4) are precisely positioned at a distance from the top of the frame which is slightly less than the distance from the sealing strips (14) to the bottom (15) of the bag to be washed. These lowermost crossbars (4) are of a length to slightly stretch the opening of the bag, and provide a surface for the sealing strips (14) of the bag to overlap and abut against, thereby acting to hold the bag on the frame. Even so, the lengths and positions of crossbars 5–8 can be established so that other bags of similar width but shorter lengths could also be fitted on the device. For example, the crossbars (5) which are next to the lowermost crossbars (4) can be positioned so that the sealing strips of a shorter bag of a similar width would overlap and abut to them, thus permitting the device to accommodate more than one size of bag, without adjustment to the device by the user. The crossbars thus being configured allow the device to accommodate bags of various lengths, with some small variation in width.

Figure 3:
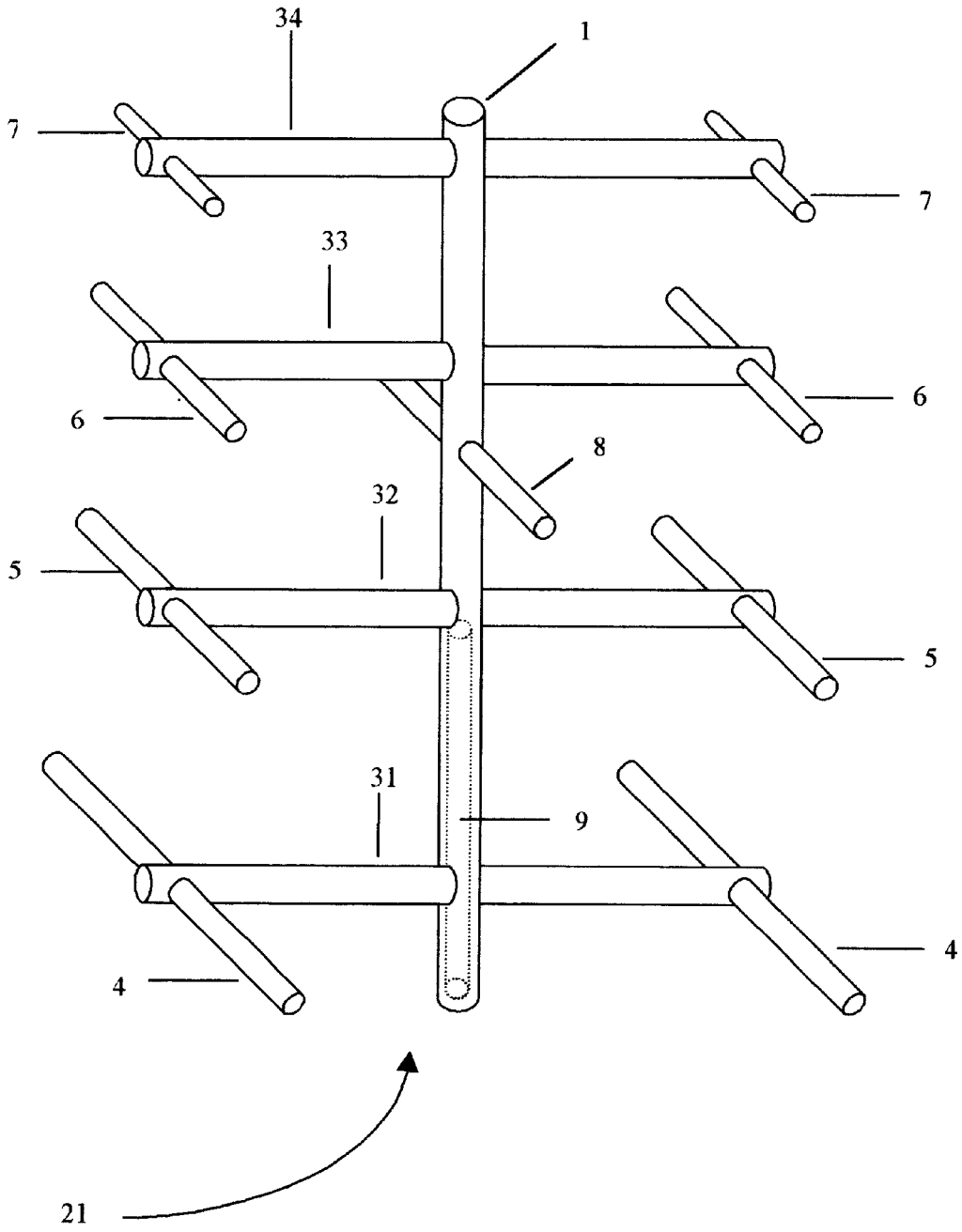
FIG. 3 of page 3 of the drawings shows an alternative embodiment of the novel device, constructed with a single main bar and multiple connecting bars.

It is the sizes and relative positions of the crossbars that provide the key to successfully opening and holding the bag to be washed. Indeed, as shown in FIG. 3, an alternative embodiment (21) would utilize a single main bar (1), with a single hole (9), and several connecting bars (31–34) on which the crossbars (4–7) would be positioned. The crossbar (8) would be positioned on the main bar (1). All that is required is the frame upon which crossbars of a predetermined size are placed in predetermined positions. Its operation would be the same as in the preferred embodiment.

Figure 4:
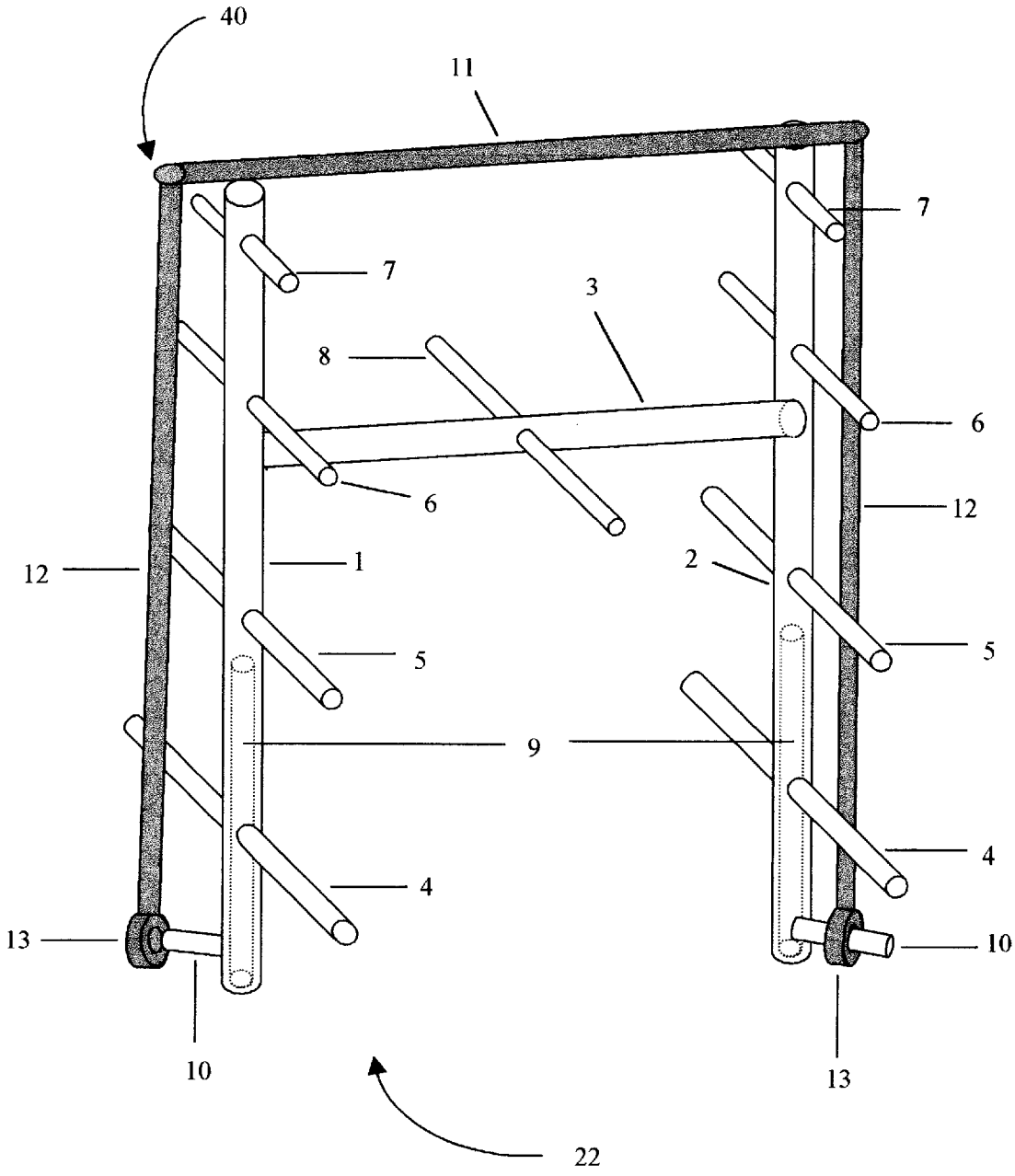
FIG. 4 on page 4 of the drawings shows a second alternative embodiment of the novel device, which includes a hold-down strap, with the hold-down strap in gray.
Figure 5:
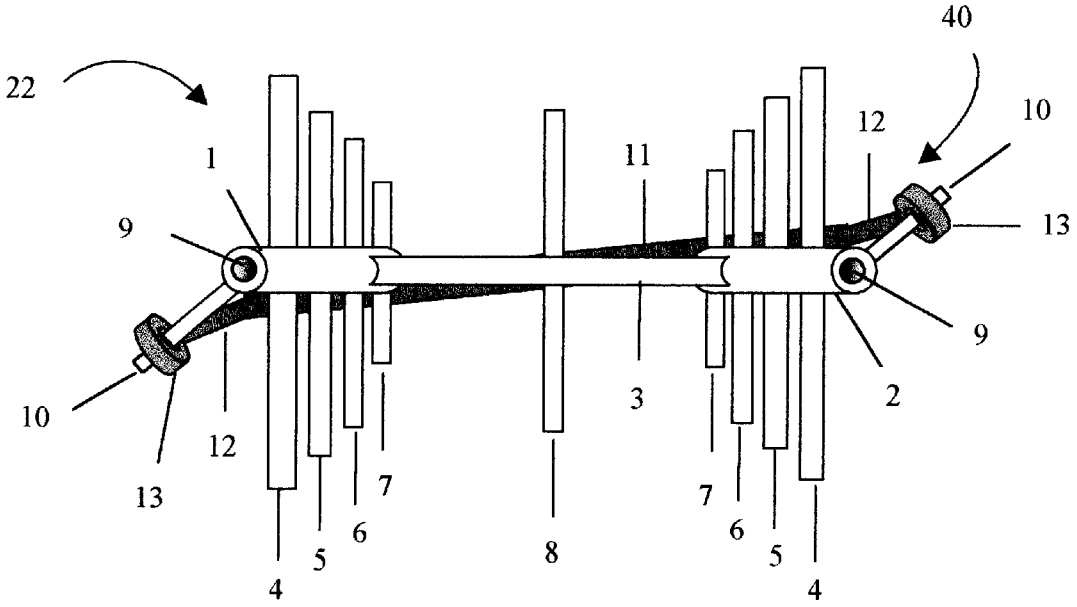
FIG. 5 on page 5 of the drawings shows the second alternative embodiment from a bottom perspective, again with the hold-down strap in gray.

A second alternative embodiment (22) is shown in FIGS. 4 and 5. It is similar to the preferred embodiment, except that it includes a hold-down strap (40) that provides additional security to the bag in case of extremely powerful water jets from a given dishwashing machine. At the bottom of each main bar 1&2, is a prong (10) that provides the means to anchor the hold-down strap (40). As seen in FIG. 5, the prongs are oriented outwards away from the center of the frame, at an angle of approximately 45 degrees from the bottom crossbar (4), and parallel to each other, so that the hold-down strap is positioned diagonally across the top of the frame when attached. As seen in FIG. 4, the hold-down strap arms (12) are flexible enough to allow them to be slightly bent apart in order to place the two donut-shaped connectors (13) over the prongs (10), securing the strap to the frame. There is a small gap between the top bar (11) of the hold-down strap and the main bars 1&2, which leaves the strap loose enough to wobble slightly, so that the dishwasher's water flow can reach the areas of the bag directly under the strap. In operation, the device would be inserted into the bag, the hold-down strap secured over the bag, then placed into the dishwasher as in the preferred embodiment.

In the best mode contemplated of constructing the invention, the device is an integral part formed of molded plastic, as would be the hold-down strap, though other materials and methods of construction are contemplated. The device could be constructed of any material which does not easily degrade within the dishwasher environment, and which is sufficiently stiff and strong enough to support such bags, such as plastic, wood, metal, etc. Some materials, such as wooden dowels, would require the assembling of the various parts as numbered in FIGS. 1–8. Using FIG. 4 as an example of such a construction method, the frame would be formed with the connecting bar (3) attached to the main bars (1&2) by drilling holes through each main bar and fitting therein. The crossbars (4–8) and prongs (10) would likewise be attached. A hole (9) would be drilled in the bottom of each main bar (1&2). The hold-down strap would be similarly formed, with the donut-shaped connectors (13) made by drilling a hole through a small slice of wood dowel, then attached to the arms (12), which are attached to the top bar (11). The device could then be coated with a waterproofing finish for durability in the dishwasher environment.

Figure 6:
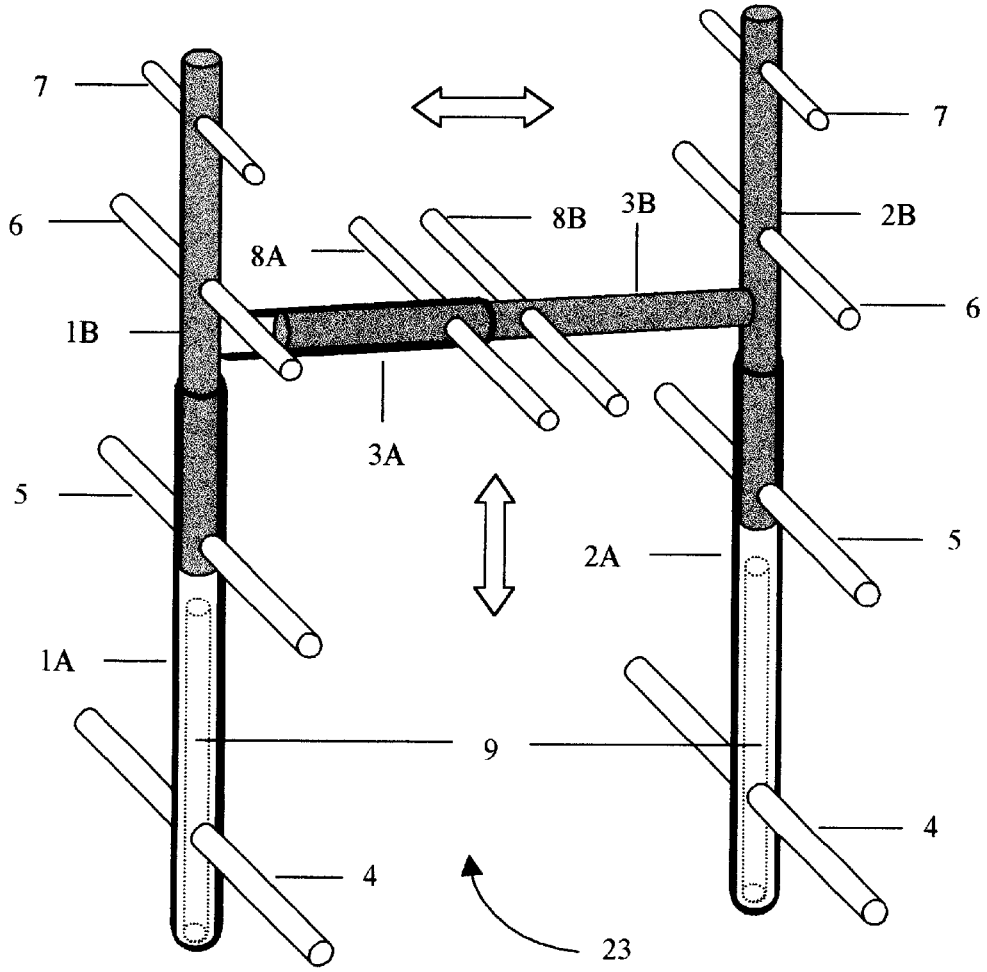
FIG. 6 on page 5 of the drawings shows a third alternative embodiment of the novel device, which is width and height adjustable.

A third alternative embodiment (23), as shown in FIG. 6, is similar to the preferred embodiment but incorporates a telescoping frame that may be adjusted to accommodate a wider range of different sizes of bags. The outside bars (1A&2B and 2A&2B) and the connecting bar (3A&3B) of the frame are comprised of pairs of friction fit tubes, wherein one part of the tube fits snugly and slidably inside the other, that can each be extended and retracted. Each half of the connecting bar has a crossbar (8A&8B) so that the symmetrical opening of the bag is maintained regardless of the width of the frame. The other parts remain the same as in the preferred embodiment. The lower crossbars would again provide the surfaces for the sealing strips of the bag to overlap and abut against, thus securing the bag to the device. To operate, the device would be inserted into the bag, then adjusted widthwise and lengthwise to fit snugly to the bag and its sealing strips by pushing or pulling on the pairs of friction fit tubes, then placed into the dishwasher as in the preferred embodiment.

Figure 7:
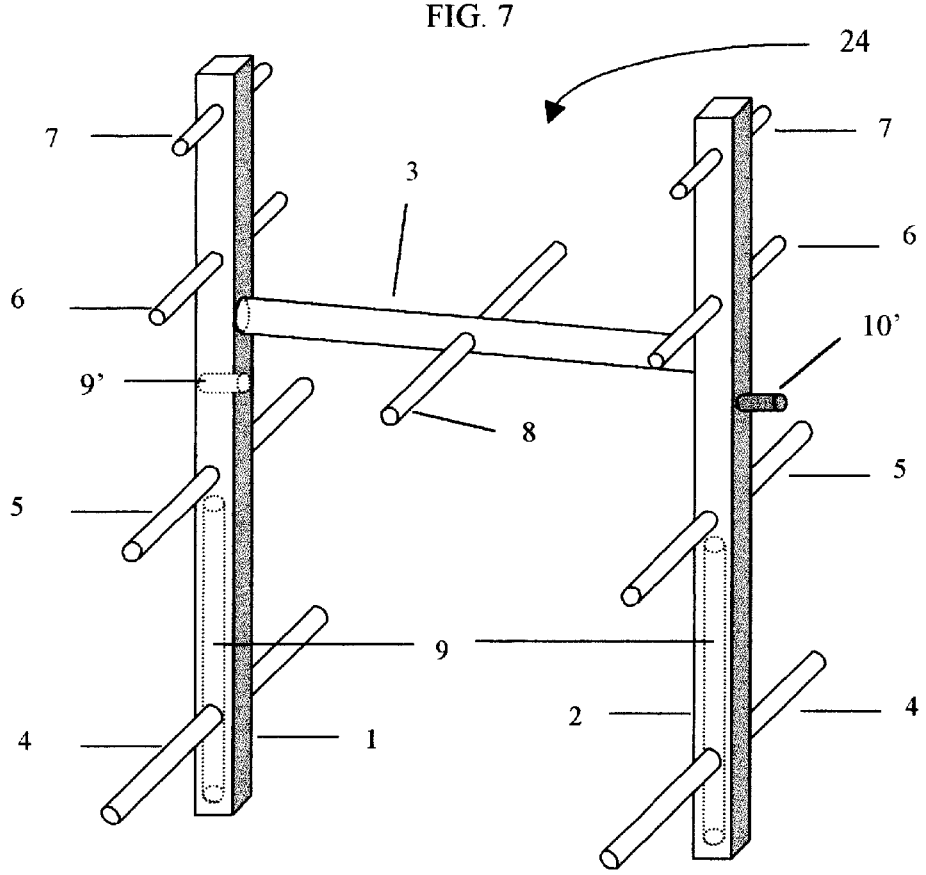
FIG. 7 on page 6 of the drawings shows a fourth alternative embodiment having main bars in the shape of elongated cubes.
Figure 8:
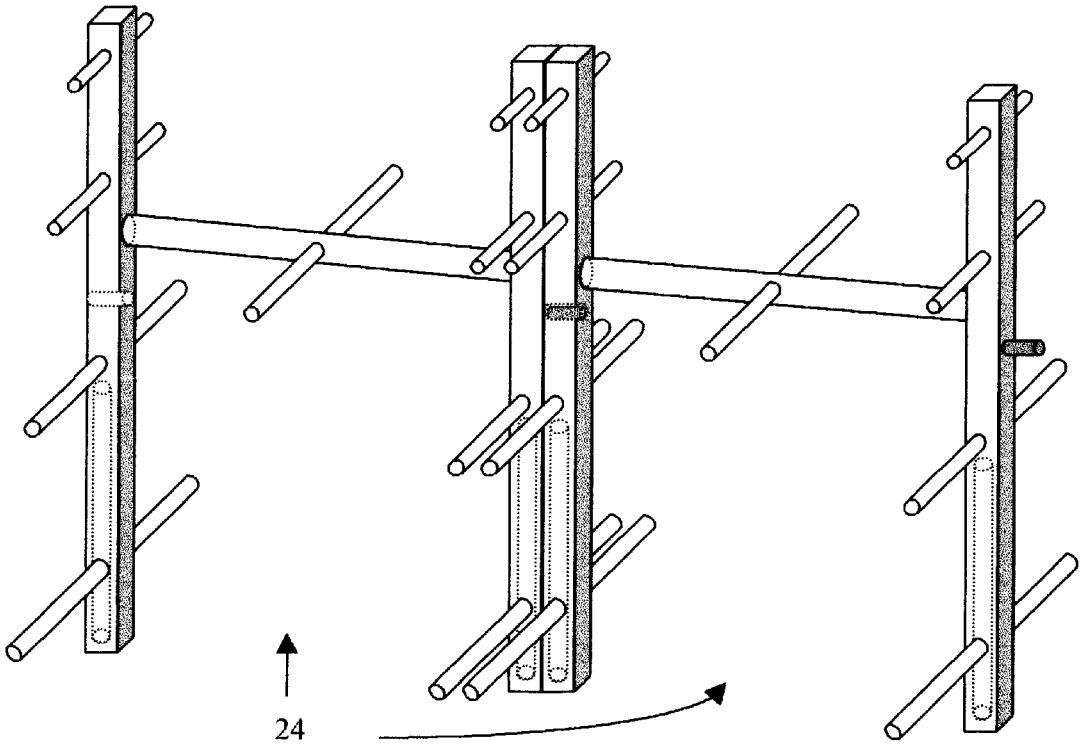
FIG. 8 on page 6 of the drawings shows a pair of the FIG. 7 devices joined side by side.

A fourth alternative embodiment (24) would utilize main bars shaped like elongated cubes, instead of cylinders, as shown in FIG. 7. The flat surfaces on either side of the device would allow the user to align two or more of the devices side by side, as shown in FIG. 8, and thus wash bags of a greater width. The devices could be joined by small prong(s) (10') and hole(s) (9') formed on the left and right sides of the device, on main bars 1&2. In operation, the joined devices would be inserted into a bag, in the same manner as for a single device, and then placed into the dishwasher as in the preferred embodiment.

In conclusion, the claimed device provides a novel approach to cleaning reusable storage bags in a dishwasher, which is versatile, effective, easy to operate, and simple and economical to construct. It minimizes user effort and maximizes the ability of a dishwashing machine to thoroughly clean such bags, thus encouraging their reuse. Though many specifications are provided herein, other variations of the device are possible, such as adding a second connecting bar to the preferred embodiment. Therefore, these specifications should not be construed as limitations on the scope of the invention, but rather as embodiments thereof; the scope of the invention being determined by the appended claims and their legal equivalents.

What I claim as my invention is:

1. A device for washing a reusable storage bag in a conventional dishwashing machine comprising:

a frame consisting of one or more main bars of a predetermined length and width; one or more connecting bars of a predetermined length and width, wherein said main bars and said connecting bars are joined substantially perpendicular in a first geometric plane;

a plurality of crossbars of a predetermined length and width, wherein said crossbars are joined at predetermined positions substantially perpendicular to said main bars and said connecting bars in a second geometric plane; and said crossbars extend both sides of said main bars and connecting bars, wherein said bag fits securely on said device with sealing strips overlapping and abutting to lowermost crossbars.

2. The device of claim 1 wherein said device includes means for securing said device to a tray of a conventional dishwasher.

3. The device of claim 2 wherein said means for securing includes a hole in the bottom of said main bars of sufficient depth and diameter to accommodate a vertical branch of said tray.

4. The device of claim 1 wherein said device is made entirely of molded plastic.

5. The device of claim 1 wherein said device is constructed by assembling separate dowel pieces together.

6. The device of claim 1 wherein said device includes a hold-down strap which fits over said bag.

7. The device of claim 6 wherein said hold-down strap is made entirely of molded plastic and an integral member of said device.

8. The device of claim 6 wherein said hold-down strap is constructed by assembling separate dowel pieces together.

9. The device of claim 1 wherein said main bars and said connecting bars formed by the interconnection of two parts, at least one of said two parts being hollow, whereby said two parts snugly and slidably fits together.

10. The device of claim 1 wherein said main bars are elongated cubes and include means for joining another said main bars.

11. The device of claim 10 wherein said means for joining includes one or more prongs and holes on a side of said main bars to align another said device.

12. A method for washing a reusable storage bag comprising the steps of:

providing a device having a frame consisting of one or more main bars of a predetermined length and width; one or more connecting bars of a predetermined length and width, wherein said main bars and said connecting bars are joined substantially perpendicular in a first geometric plane; a plurality of crossbars of a predetermined length and width, wherein said crossbars are joined at predetermined positions substantially perpendicular to said main bars and said connecting bars in a second geometric plane; and said crossbars extend both sides of said main bars and connecting bars, wherein said bag fits securely on said device with sealing strips overlapping and abutting to lowermost crossbars;

placing said bag onto said device, wherein sealing strips of said bag overlap and abut to said crossbars;

placing said device in a conventional dishwasher such that opening of the bag aligns with washing jets of said dishwasher; and running said dishwasher through a wash cycle.

13. The method recited in claim 12 wherein said bag is secured to said device by placing a hold-down strap around exterior of said bag.

14. The method recited in claim 12 wherein said dishwasher run through a wash and a dry cycles.

15. The method recited in claim 12 wherein said device is removed from said dishwasher and allow to air dry.

* * * * *